United States Patent [19]

Sick

[11] Patent Number: 4,538,536

[45] Date of Patent: Sep. 3, 1985

[54] OPTICAL APPARATUS FOR MONITORING FOR THREAD BREAKAGE

[75] Inventor: Erwin Sick, Icking, Fed. Rep. of Germany

[73] Assignee: Erwin Sick GmbH Optik-Elektronik, Waldkirch, Fed. Rep. of Germany

[21] Appl. No.: 606,306

[22] Filed: May 2, 1984

[30] Foreign Application Priority Data

May 11, 1983 [DE] Fed. Rep. of Germany ..... 3317323
Sep. 2, 1983 [DE] Fed. Rep. of Germany ..... 3331772

[51] Int. Cl.[3] ..... B65N 63/00; D05B 69/63

[52] U.S. Cl. ..... 112/273; 112/278; 112/79 R; 250/561; 200/61.18

[58] Field of Search ..... 112/79 R, 273, 278; 250/561, 571; 66/163; 200/61.18

[56] References Cited

U.S. PATENT DOCUMENTS

| | | | |
|---|---|---|---|
| 3,174,046 | 3/1965 | Lindemann | 112/273 |
| 3,401,267 | 9/1968 | Engle et al. | 250/561 |
| 3,429,146 | 2/1969 | Cvach | 66/163 |
| 3,530,690 | 9/1970 | Nickell et al. | 66/163 |
| 3,575,515 | 4/1971 | Fertig | 66/163 X |
| 3,628,030 | 12/1971 | Fertig et al. | 66/163 X |
| 3,677,307 | 7/1972 | Fiorucci | 66/163 |
| 3,824,401 | 7/1974 | Suzuki | 250/561 |
| 4,111,136 | 9/1978 | Spanel | 112/79 R |
| 4,248,272 | 2/1981 | Wilson et al. | 250/561 |
| 4,300,599 | 11/1981 | Wueger | 66/163 |
| 4,311,916 | 1/1982 | Schenkel | 250/561 |

*Primary Examiner*—Ronald Feldbaum
*Attorney, Agent, or Firm*—Townsend and Townsend

[57] ABSTRACT

A laser beam scanning device (17) is provided for monitoring for thread breakage in tufting machines (31) in which a carrier web (16) is passed from below to a spiked roller (11) and is deflected by the spiked roller into a substantially horizontal direction so that it can be passed beneath a row of needles (12). The row of needles (12) periodically introduce threads into the carrier web (16) by up and down movement in order to form tufted material. A narrow retro-reflecting strip (14) is arranged directly below and behind the tips of the needles and directly above the tufted material (15) parallel to the row of needles (12) and substantially at right angles to the surface of the tufted material. The scanned light beam (18) is regularly interrupted by the threads which pass through the needles (13) when the needles are in the elevated open position and, after reflection at the retroflecting strip (14) and other optical elements, is received by a photoelectric receiver (19) where it generates an AC output signal. If one of the threads is broken then the scanning beam (18) is not interrupted at this position and this is recognised in the output signal from the light receiver (19).

14 Claims, 2 Drawing Figures

OPTICAL APPARATUS FOR MONITORING FOR THREAD BREAKAGE

Figure 1:
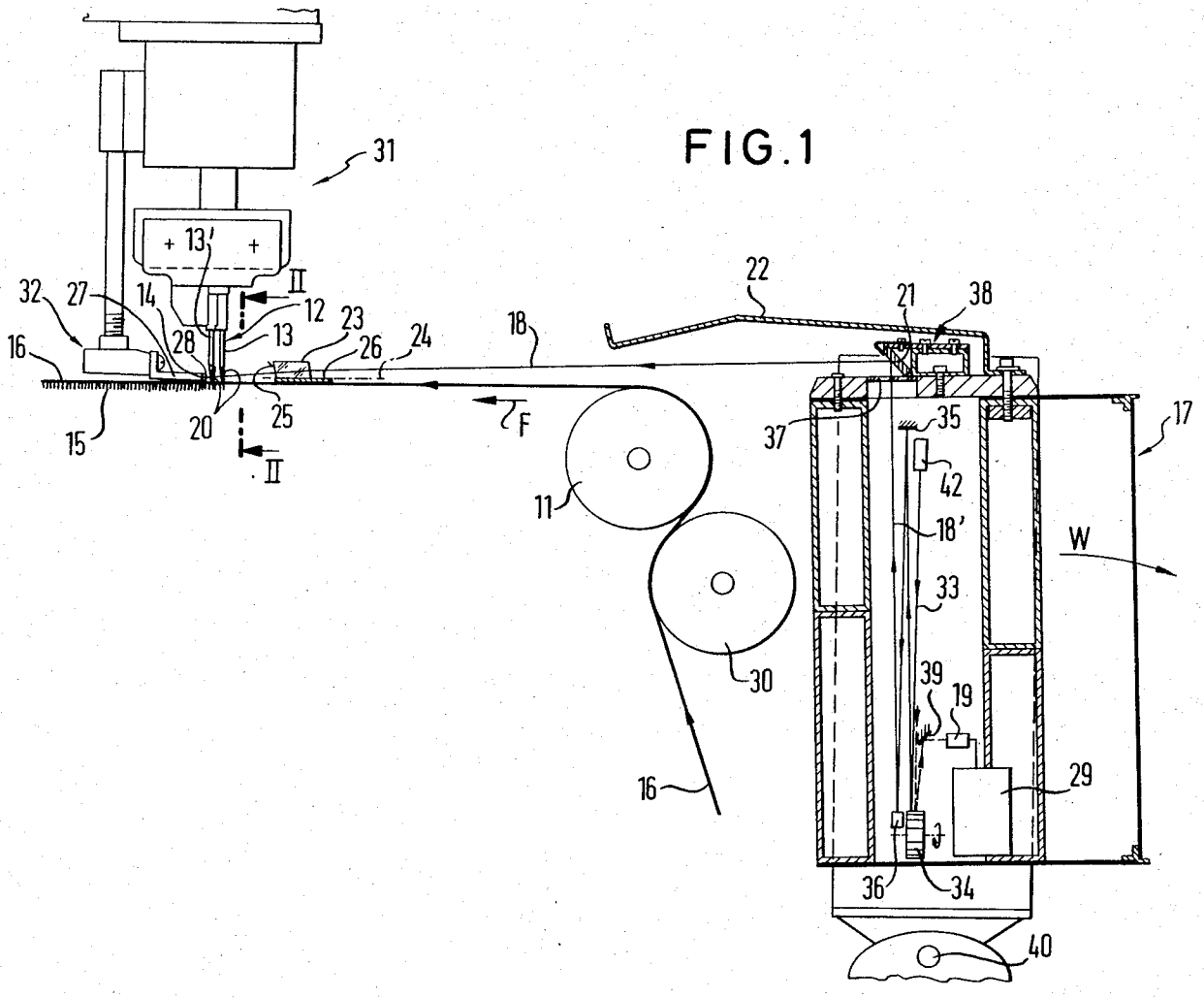

The invention relates to an optical apparatus for monitoring for thread breakage in tufting machines in which a carrier web is passed upwardly to a spiked roller and is deflected by the spiked roller into a substantially horizontal direction so that it can be passed under a row of needles which, in order to form tufted material, periodically introduces threads into the carrier web by up and down movement, said monitoring apparatus making use of a laser beam scanning device.

Optical laser scanning devices for monitoring for faults in textile webs, paper webs or metal surfaces are known. They generally operate with a laser light source, a subsequent optical system, a rotating mirror wheel and a strip-like concave mirror. In this way a scanning beam is generated with which the material web can be scanned, with the scanning beam being cyclically displaced parallel to itself in a plane. The light which is either scattered back or reflected back into the beam path can be used in order to detect a fault signal, for example by reflecting this light out of the beam path by a beam divider which follows the mirror wheel. Another possibility is the utilisation of the scattered light which leaves every retroreflector within a narrow angular range. This scattered light falls on the mirror wheel alongside the transmitted light beam so that the received light can be geometrically separated from the transmitted light beam by a suitably arranged deflecting mirror.

In machines which manufacture tufted material the problem exists that, for space reasons, a laser beam scanning device cannot be arranged in the immediate vicinity of the needle row which is to be monitored.

The object underlying the invention is thus to provide an optical apparatus for monitoring for thread breakage in tufting machines, with the apparatus being capable of being arranged at a location which is remote from the row of needles and which, from the point of view of the space requirement, is readily available to accommodate the laser beam scanning device, and with the apparatus nevertheless permitting problemfree monitoring for thread or needle breakage.

In order to satisfy this object the invention provides that when the needles are open a preferably narrow retroreflecting strip is arranged directly below and behind the needle tips and directly above the tufted material, parallel to the row of needles and substantially at right angles to the surface of the tufted material; and that the laser beam scanning device is arranged in front of the spiked roller, wherein said laser beam scanning device generates a scanning beam which periodically scans the retroreflecting strip and which extends substantially parallel to the part of the carrier web extending between the spiked roller and the row of needles and at right angles to the retroreflecting strip, and wherein said laser beam scanning device contains a light receiver operating in an autocollimating arrangement, said light receiver being connected to an electronic fault evaluating circuit which transmits a fault signal if a scanning beam interruption signal caused by the absence of a thread extending through the needles, or between the needles and the carrier web, is missing.

Thus, in accordance with the invention, the laser beam scanning device is arranged at a relatively large distance from the row of needles which is to be monitored with regard to thread breakage. Only a narrow retroreflecting strip, for example "Scotchlite" is arranged in the immediate vicinity of the tips of the needles, preferably at the end face of a hold-down rail. Because of its narrowness this strip can be accommodated without problem at the required location.

The electronic fault evaluating circuit monitors the frequency generated by scanning the needles or threads and determines when an interruption signal is suddenly missing due to a broken thread. This is then indicated by an acoustic or optical signal. The signal can however also stop the machine if this is desired.

A particularly preferred, space saving, spatial arrangement is obtained when the laser beam scanning device is vertically arranged in front of the spiked roller and substantially beneath the level of the row of needles; and when a strip-like deflecting mirror arranged substantially level with and parallel to the row of the needles deflects the scanning beam, which emerges substantially vertically out of the laser beam scanning device, in the direction towards the retroreflecting strip. In this manner the laser beam scanning device only projects in an upward direction fractionally beyond the spiked roller. This special arrangement of the laser beam scanning device can be exploited for the mounting of a sheet metal guard which extends from the upper end of the laser beam scanning device towards the row of needles over the spiked roller. The sheet metal guard protects the optical elements provided at the upper end of the laser beam scanning device against contact or contamination and also protects the operator from injuring himself on the spiked roller.

In order to be able to carry out repairs to the tufting machine without problem a further embodiment is constructed so that the laser beam scanning device is journalled at a pivot bearing in such a way that it can be swung downwardly, preferably through 180°. In this manner the laser beam scanning device can be swung without problem out of the way of the areas of the tufting machine which have to be inspected or repaired.

It is particularly advantageous if a cylindrical lens is arranged in the scanning beam just in front of the row of needles, with the cylindrical lens focussing the scanning beam in the region of the threads. The arrangement should in particular be such that the cylindrical lens simultaneously deflects the scanning beam somewhat in the direction of the retroreflecting strip. The construction is preferably such that the scanning beam enters the cylindrical lens above the optical axis with the cylindrical lens terminating at the bottom in the region of the optical axis. The scanning beam exit surface of the cylindrical lens should in particular be arranged substantially at right angles to the deflected scanning beam. It is expedient for the cylindrical lens to be arranged from 20 to 30 and in particular approximately 25 mm in front of the row of needles.

In this manner the scanning beam is focussed in the region of the threads. The cylindrical lens can be made very narrow and of small height, in correspondence with the scanning beam, so that its arrangement just in front of the row of needles is hardly disturbing.

It is particularly preferable for the cylindrical lens to simultaneously serve as a mechanical hold-down device for the carrier web. This embodiment should in particular be constructed so that a metal or synthetic rail into which the cylindrical lens is secured is arranged between the lower flat surface of the cylindrical lens and the carrier web.

Thus, in accordance with the invention, the cylindrical lens has a double function, it namely serves on the one hand as an optical concentrating element and on the other hand as a mechanical hold-down device for the carrier web. This avoids, in particular, fluttering or other movements of the carrier web directly in front of the needle row, which counteracts the danger of thread breakage and also favours the optical detection of thread breakages.

Finally, it is expedient if the retroreflecting strip is secured to the front edge of a rail which extends directly above the tufted material towards the row of needles and which contacts the tufted material from above and thus guides it, at least in the region of the retroreflecting strip. This hold-down rail thus also satisfies a double function as a hold-down device and as a carrier for the retroreflecting strip.

Thus mechanical hold-down elements which simultaneously carry optical elements, and thus satisfy a function within the optical thread monitoring device, are located just in front of and directly behind the row of needles.

Figure 2:
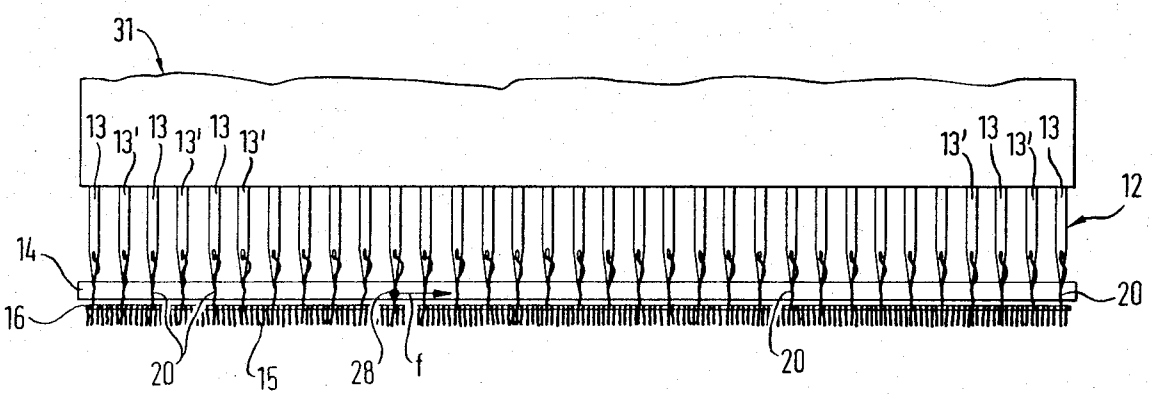

The invention will now be descrlbed in the following by way of example and with reference to the drawings which show:

FIG. 1 is a schematic side view of a part of a tufting machine including the optical apparatus for monitoring for thread breakage, and FIG. 2 is a sectional view on the line II—II of FIG. 1.

As seen in the drawing a carrier web 16 is guided from a supply wheel, which is not shown but which can be imagined as being disposed at the bottom of FIG. 1, upwardly over a tensioning roller 30 to a spiked roller 11 which deflects the carrier web 16 substantially into a horizontal direction. The carrier web 16 is then passed beneath a row of needles 12 of a tufting machine 31 which consists of two lines of needles 13, 13' arranged in displaced manner one behind the other. The needles are displaced in this way so that they can be arranged laterally side by side as close to one another as possible.

The needles 13, 13' execute a periodic and down movement and in this way push threads 20 into the carrier material 16 thus finally resulting in the tufted material 15 which is to be manufactured. During the manufacturing process the carrier web 16 or the tufted material 15 is continuously moved on the direction of the arrow F.

A retroreflecting strip 14, for example of "Scotchlite", is arranged directly beneath and behind the needles. It is secured to the narrow end face of a hold-down rail 27, generally by adhesive. The hold-down rail 27 is shown in FIG. 1 as an angle iron which is secured in suitable manner to the tufting machine 31 via a carrier construction 32.

A relatively thin hold-down rail 26 which mechanically contacts the carrier web 16 from above extends above the carrier web 16 at a distance of ca. 25 mm in front of the row of needles.

A laser beam scanning device 17 is vertically secured in front of the rollers 11, 30 and generates a vertical scanning beam 18' which executes a periodic scanning movement in a direction at right angles to the plane of the drawing of FIG. 1. This can for example be achieved in known manner by an arrangement in which a laser 42 directs a transmitted light beam 33 onto a mirror wheel 34, optionally via a non-illustrated suitable optical system. The light then passes from the mirror wheel 34 to a strip-like mirror 35 in a (likewise known) Z-beam path, and the strip mirror 35 then directs the beam to a strip-like concave mirror 36. The reflecting surface on the mirror wheel 34 is located at the focal point of the concave mirror 36. A to and fro movement of the scanning beam 18' could also be realised by an oscillating mirror in place of the mirror wheel 34. The scanning beam 18' emerges from the laser beam scanning device 17 through a light exit window 37 at right angles thereto.

A 90° deflecting mirror 21, which is likewise of strip-like form (at right angles to the plane of the drawing of FIG. 1), is located directly above the light exit window 37 and secured to the upper end of the laser beam scanning device 17 by means of a holder 38.

The deflecting mirror 21 deflects the vertical scanning beam 18' into a substantially horizontal direction. The scanning beam 18 which is generated in this way moves continuously and gradually closer to the carrier web 16, in the manner shown in FIG. 1 and finally enters the cylindrical lens 23. The optical axis 24 of the cylindrical lens is located at its lower end in the boundary region adjacent the carrier rail 26 whereby the scanning beam 18 is not only concentrated but is also somewhat deflected in the direction of the carrier web 16. The refracting characteristics of the cylindrical lens 23 are selected so that a narrow light beam 28 is generated on the surface of the retro-reflecting strip 14. The exit surface 25 of the cylindrical lens 23 is substantially at right angles to the deflected scanning beam 18.

When the mirror wheel 34 is rotating the scanning light bead 28 executes a periodic linear movement on the retroreflecting strip 14 in the direction of the arrow f of FIG. 2, i.e. at right angles to the plane of the drawing of FIG. 1. The scanning beam 18 is interrupted in a regular periodic sequence by the threads 20 which extend between the tips of the needles and the tufted material 15 when the needles are open.

A sheet metal guard 22 is secured above the laser beam scanning device 17 to the latter and protects the light exit window 37 and the strip-like deflecting mirror 21 against external damage. Moreover, the sheet metal guard 22 extends over the spiked roller 11 so that the operator is also protected from injuring himself on this roller.

The retroflecting material 14 reflects the incident light substantially back on itself to the deflecting mirror 21 and finally to the mirror wheel 34. As the retroreflecting material 14 has however a certain scattering effect the scattered light not only falls on the mirror wheel 34 at the position at which the transmitted light 33 falls on the mirror wheel but rather also alongside this point. This is schematically illustrated in the drawing by broken lines. By arranging a deflecting mirror 39 alongside the transmitted light beam 33 the deflecting mirror 39 can receive light scattered by the retroreflector 14 and deflect it to a light receiver 19 which is connected to a schematically illustrated electronic fault evaluation circuit 29.

As can be seen from FIG. 1 the laser beam scanning device 17 is pivotally journalled at a pivot bearing 40 about an axis which extends parallel to the row of needles 12, so that it can be pivoted downwardly in the direction of the arrow W through 180°. In this way the rollers 11, 13 and other parts of the tufting machine can be make accessible when necessary.

The electronic fault evaluating circuit 29 monitors the frequency generated by scanning the row of needles 12 and the threads 20 and transmits a fault signal when a thread 20 is broken and a signal indicating interruption of the scanning beam is missing at this point.

As the distance between the tufted material 15 and the tips of the opened needles 13, 13', i.e. wherein in the upper, raised position, is only a few millimeters the retroreflecting strip 14 is also only a few millimeters wide.

I claim:

1. Optical apparatus for monitoring for thread breakage in tufting machines in which a carrier web is passed upwardly to a spiked roller and is deflected by the spiked roller into a substantially horizontal direction so that it can be passed under a row of needles which, in order to form tufted material, periodically introduces threads into the carrier web by up and down movement, said monitoring apparatus making use of a laser beam scanning device, characterised in that when the needles (13) are open a preferably narrow retroreflecting strip (14) is arranged directly below and behind the needle tips and directly above the tufted material (15), parallel to the row of needles (12) and substantially at right angles to the surface of the tufted material; and in that the laser beam scanning device (17) is arranged in front of the spiked roller (11), wherein said laser beam scanning device generates a scanning beam (18) which periodically scans the retroreflecting strip (14) and which extends substantially parallel to the part of the carrier web (16) extending between the spiked roller (11) and the row of needles (12) and at right angles to the retroreflecting strip (18), and wherein said laser beam scanning device contains a light receiver (19) operating in an autocollimating arrangement, said light receiver (19) being connected to an electronic fault evaluating circuit (29) which transmits a fault signal if a scanning beam interruption signal caused by the absence of a thread (20) extending through the needles (13) or between the needles (13) and the carrier web (16) is missing.

2. Optical apparatus in accordance with claim 1, characterised in that the laser beam scanning device (17) is vertically arranged in front of the spiked roller (11) and substantially beneath the level of the row of needles (12); and in that a strip-like deflecting mirror (21) arranged substantially level with and parallel to the row of needles (12) deflects the scanning beam (18'), which emerges substantially vertically out of the laser beam scanning device, in the direction towards the retroreflecting strip (14).

3. Optical apparatus in accordance with claim 1 characterised in that a sheet metal guard (22) extends from the upper end of the laser beam scanning device (17) towards the row of needles (12) over the spiked roller (11).

4. Optical apparatus in accordance with claim 1, characterised in that the laser beam scanning device (17) is journalled at a pivot bearing (40) in such a way that it can be swung downwardly, preferably through 180°.

5. Optical apparatus in accordance with claim 1, characterised in that a cylindrical lens (23) is arranged in the scanning beam (18) just in front of the row of needles (12), said cylindrical lens focussing the scanning beam (18) just in front of the row of needles (12), in particular beneath the row of needles (12), or shortly behind the row of needles (12).

6. Optical apparatus in accordance with claim 5, characterised in that the cylindrical lens (23) simultaneously deflects the scanning beam (18) somewhat in the direction of the retroreflecting strip (14).

7. Optical apparatus in accordance with claim 6, characterised in that the scanning beam (18) enters the cylindrical lens (23) above the optical axis (24) and the cylindrical lens (23) terminates at the bottom in the region of the optical axis (24).

8. Optical apparatus in accordance with claim 6, characterised in that the scanning beam exit surface (25) of the cylindrical lens (23) is arranged substantially at right angles to the deflected scanning beam (18).

9. Optical apparatus in accordance with claim 6, characterised in that the cylindrical lens (23) is arranged from 20 to 30 and in particular approximately 25 mm in front of the row of needles (12).

10. Optical apparatus in accordance with claim 6, characterised in that the cylindrical lens (23) simultaneously serves as a mechanical hold-down device for the carrier web (16).

11. Optical apparatus in accordance with claim 10, characterised in that a metal or synthetic rail (26) into which the cylindrical lens (23) is secured is arranged between the lower flat surface of the cylindrical lens (23) and the carrier web (16).

12. Optical apparatus in accordance with claim 1, characterised in that the retroreflecting strip (14) is secured to the front edge of a rail (27) which extends directly above the tufted material (15) towards the row of needles and which contacts the tufted material from above and thus guides it at least in the region of the retroreflecting strip (14).

13. Optical apparatus in accordance with claim 2, characterised in that a strip-like light exit window (37) is located at the upper end of the housing of the laser beam scanning device (17), with the deflecting mirror (21) being arranged above and parallel to the light exit window (37) and preferably being protected by the sheet metal guard (22).

14. Optical apparatus in accordance with claim 2, characterised in that the deflecting mirror (21) is located inside the housing of the laser beam scanning device (17), in order to house the deflecting mirror in a protected manner; and in that a step-like light exit window extending in the direction of the row of needles (12) is provided at the side of the upper end region of the housing for the laser beam scanning device (17).

* * * * *